US009184526B2

(12) United States Patent
Tamaki et al.

(10) Patent No.: US 9,184,526 B2
(45) Date of Patent: Nov. 10, 2015

(54) METHOD FOR MANUFACTURING TERMINAL, AND TERMINAL

(71) Applicant: MABUCHI MOTOR CO., LTD., Chiba (JP)

(72) Inventors: Takashi Tamaki, Chiba (JP); Kouichi Ueki, Chiba (JP); Akihiro Oosawa, Chiba (JP)

(73) Assignee: Mabuchi Motor Co., Ltd., Matsudo, Chiba (JP)

( * ) Notice: Subject to any disclaimer, the term of this patent is extended or adjusted under 35 U.S.C. 154(b) by 43 days.

(21) Appl. No.: 14/029,067

(22) Filed: Sep. 17, 2013

(65) Prior Publication Data

US 2014/0080366 A1 Mar. 20, 2014

(30) Foreign Application Priority Data

Sep. 20, 2012 (JP) ..... 2012-207438

(51) Int. Cl.

| | |
|---|---|
| ***H01R 11/12*** | (2006.01) |
| ***H01R 13/15*** | (2006.01) |
| ***H01R 43/16*** | (2006.01) |
| ***H01R 13/11*** | (2006.01) |

(52) U.S. Cl.

CPC ..... *H01R 13/15* (2013.01); *H01R 13/112* (2013.01); *H01R 43/16* (2013.01); *Y10T 29/49204* (2015.01)

(58) Field of Classification Search

CPC ..... H01R 13/112

USPC ..... 439/856, 857

See application file for complete search history.

(56) References Cited

U.S. PATENT DOCUMENTS

| | | | | |
|---|---|---|---|---|
| 4,943,248 | A * | 7/1990 | Colleran et al. | 439/850 |
| 5,599,213 | A | 2/1997 | Frommer et al. | |
| 6,254,440 | B1 * | 7/2001 | Ko et al. | 439/857 |
| 6,286,209 | B1 * | 9/2001 | Mitra | H01R 13/112 29/874 |
| 2001/0049238 | A1 * | 12/2001 | Brammer et al. | 439/857 |

FOREIGN PATENT DOCUMENTS

| | | | |
|---|---|---|---|
| CN | 1282994 | A | 2/2001 |
| DE | 29922831 | U1 | 3/2000 |
| JP | Hei7-326417 | A | 12/1995 |
| JP | 2001-326010 | | 11/2001 |

OTHER PUBLICATIONS

Office Action from the Chinese Patent Office for Application No. 2013103195204, mailed Jun. 2, 2015 (with English translation).

* cited by examiner

*Primary Examiner* — Phuong Dinh

(74) *Attorney, Agent, or Firm* — Schwabe, Williamson & Wyatt

(57) ABSTRACT

A method for manufacturing a terminal that has electrical connection with a component by pinching and holding the component using a pinching part provided in a part of each of two arms. The method includes a first process of forming a first gap G1 between the two pinching parts, and a second process of plastically deforming a part of the arms so as to make the gap between the pinching parts to be a second gap G2 smaller than the first gap G1.

1 Claim, 9 Drawing Sheets

METHOD FOR MANUFACTURING TERMINAL, AND TERMINAL

CROSS-REFERENCE TO RELATED APPLICATIONS

This application is based upon and claims the benefit of priority from the prior Japanese Patent Application No. 2012-207438, filed on Sep. 20, 2012, the entire content of which is incorporated herein by reference.

BACKGROUND OF THE INVENTION

1. Field of the Invention

The present invention relates to a terminal, and particularly to a terminal used for a power feeding portion of a motor.

2. Description of the Related Art

Small DC motors have been conventionally used for various devices including automotive electrical components, such as a power window opening/closing device, an automotive door lock operating device, a retractable power door mirror, and an air conditioner. In order to externally supply power to such a motor, a terminal is provided on a power feeding path.

Although various methods for manufacturing terminals have been devised, many terminals are generally manufactured by stamping metal plates into desired shapes.

However, when a terminal configured to pinch the other terminal with two arms at the tip is to be manufactured by stamping a metal plate into the shape of the terminal, it is difficult to form the gap between the arms at the tip to be smaller than or equal to the thickness of the metal plate. Accordingly, when the other terminal has a small thickness, the connection reliability at the power feeding portion might have to be improved depending on the size of the gap between the arms.

SUMMARY OF THE INVENTION

The present invention has been made in view of such a situation, and a purpose thereof is to provide a terminal having great connection reliability when power is supplied.

To solve the problem above, one embodiment of the present invention is a method for manufacturing a terminal that has electrical connection with a component by pinching and holding the component using a pinching part provided in a part of each of two arms. The method comprises a first process of forming a first gap between the two pinching parts, and a second process of plastically deforming a part of the arms so as to make the gap between the pinching parts to be a second gap smaller than the first gap.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
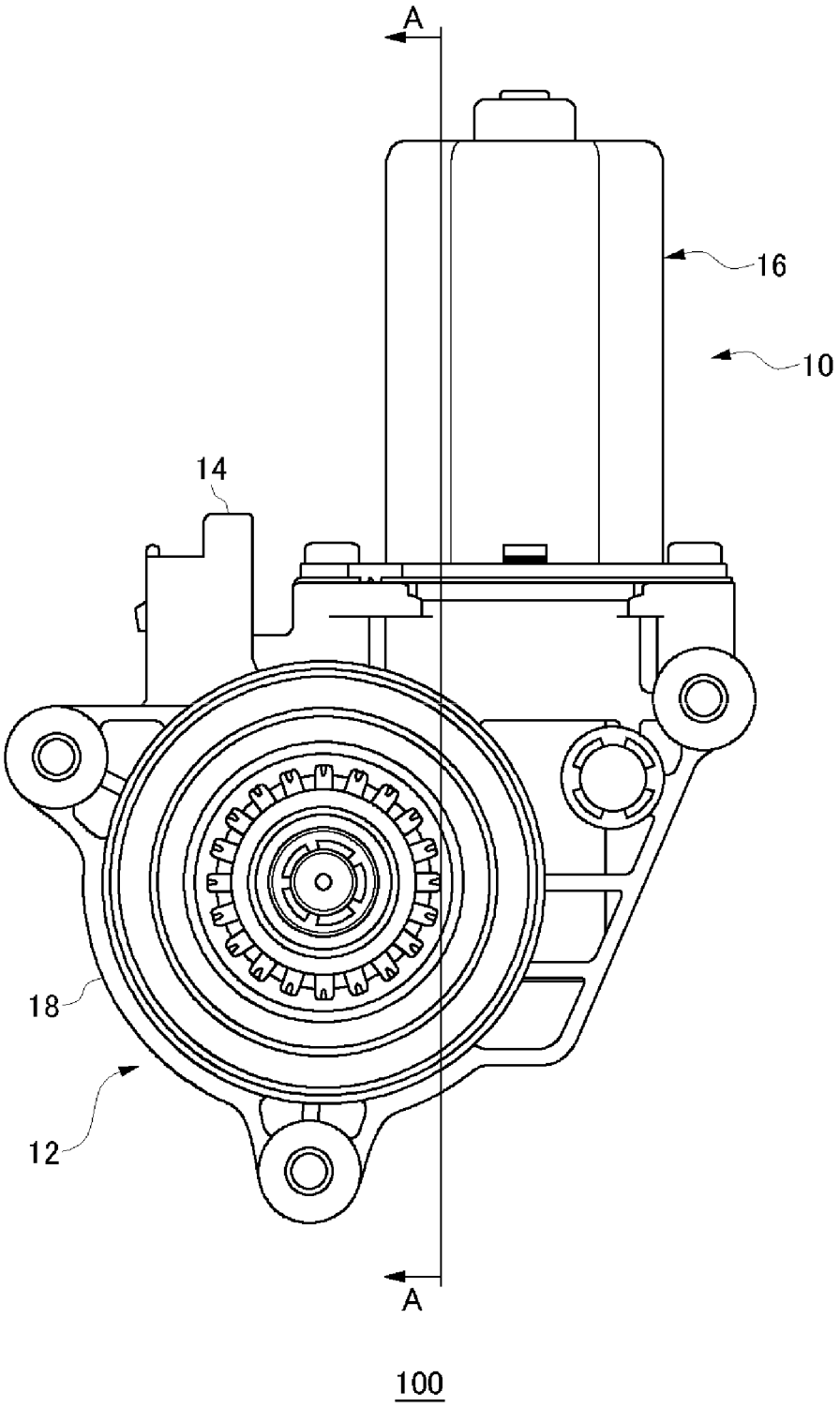
FIG. 1 is a front view of a DC motor with a reduction gear viewed from the output shaft side according to the present embodiment.

The invention will now be described by reference to the preferred embodiments. This does not intend to limit the scope of the present invention, but to exemplify the invention.

A terminal according to the present invention is used for power feeding to various devices and suitable for motors used in automotive electrical components, such as power window systems, sunroofs, power seats, and door closures for vehicles.

One embodiment of the present invention is a method for manufacturing a terminal that has electrical connection with a component by pinching and holding the component using a pinching part provided in a part of each of two arms. The method comprises a first process of forming a first gap between the two pinching parts, and a second process of plastically deforming a part of the arms so as to make the gap between the pinching parts to be a second gap smaller than the first gap.

According to this embodiment, the gap between the pinching parts can be formed to be a small gap that cannot be obtained by a single process. Therefore, even if a component is rather thin, the terminal can certainly pinch and hold the component. As a result, connection reliability between the terminal and the component can be improved.

In the second process, a thinner part, which is thinner than the other parts, may be formed by partially crushing (pressing) the pinching parts. Accordingly, the fillet (volume) of the crushed portion merges into the surrounding part to enlarge the pinching parts, so that the gap between the pinching parts can be made smaller.

In the second process, the arms may be partially pressed in directions so that the pinching parts are brought closer to each other. Accordingly, the gap between the pinching parts can be made smaller.

In the first process, the first gap may be formed by stamping a part of a plate member. Accordingly, the first gap can be easily provided in the first process.

Another embodiment of the present invention is a terminal. The terminal has electrical connection with a component by pinching and holding the component. The terminal comprises a pair of pinching parts, a pair of arms that are provided with the pinching parts, respectively, and a linking section (connecting part) that links (connects) the pair of arms. The pinching parts include a gap adjustment part configured to adjust the gap between the pair of pinching parts.

According to this embodiment, the gap between a pair of pinching parts can be adjusted to be closer to a desired value by means of a gap adjustment part provided in the pinching parts.

The gap adjustment part may be a thinner part formed to be thinner than the other parts by partially crushing the pinching parts. Accordingly, the fillet of the crushed portion merges into the surrounding part to enlarge the pinching parts, so that the gap between the pinching parts becomes smaller.

Each of the pinching parts may further include an abutting part that abuts onto a component when the pinching parts pinch and hold the component. A thinner part may be formed to not include an abutting part. Accordingly, since the thinner part is formed to not reach the abutting part, the thinner part does not abut onto a component when the pinching parts pinch the component, so that the contact area between the abutting part and the component is not decreased. Consequently, connection reliability between the terminal and the component will not be degraded.

The pair of pinching parts, the pair of arms, and the linking section may be formed of an integrated member of a flat plate shape. Accordingly, the terminal can be manufactured inexpensively using simple processes.

Optional combinations of the aforementioned constituting elements, and implementations of the invention in the form of methods, apparatuses, or systems may also be practiced as additional modes of the present invention.

In the following, an embodiment of the present invention will be described with reference to the drawings. In the drawings, like reference characters designate like or corresponding elements, and the description thereof will not be repeated for brevity. Also, the configurations described below are intended to be illustrative only and do not provide any limitation on the scope of the present invention.

FIG. 1 is a front view of a reduction gear-equipped DC motor 100 viewed from the output shaft side according to the present embodiment. The reduction gear-equipped DC motor 100 comprises a motor unit 10, a reduction gear 12 connected to the shaft of the motor unit 10, and a connector 14 used for power feeding from the external. The motor unit 10 includes a cylindrical housing 16, and the reduction gear 12 includes a cylindrical casing 18 that houses a worm wheel.

Figure 2:
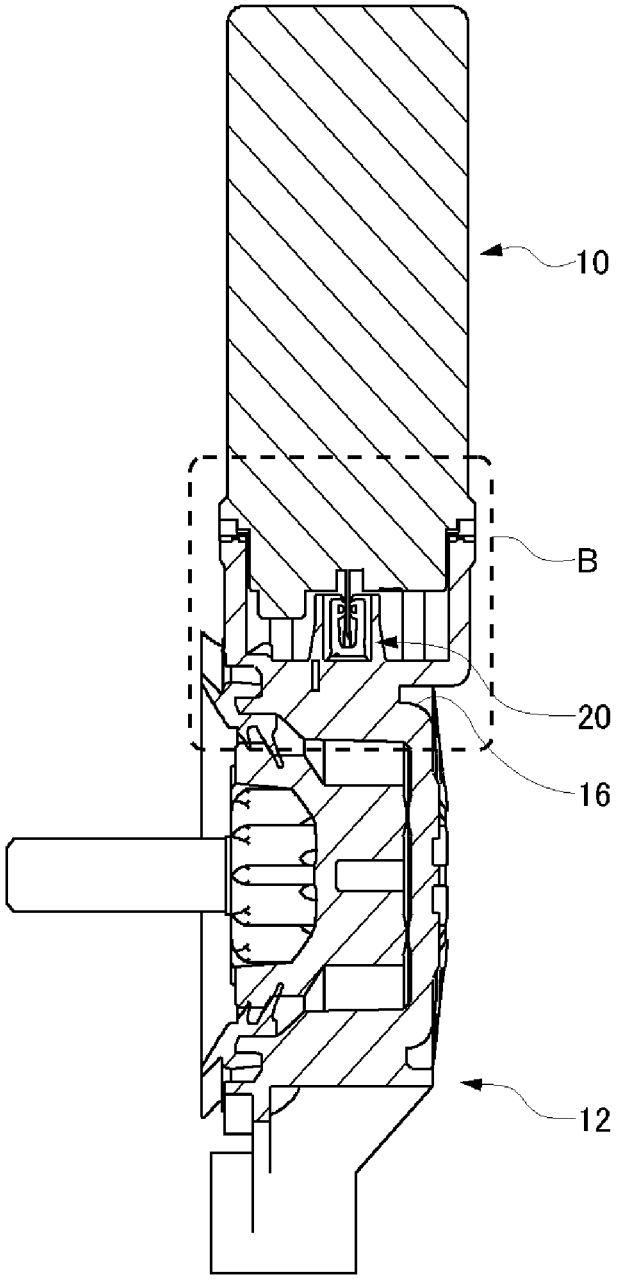
FIG. 2 is a sectional view of the DC motor with a reduction gear taken along line A-A of FIG. 1.
Figure 3:
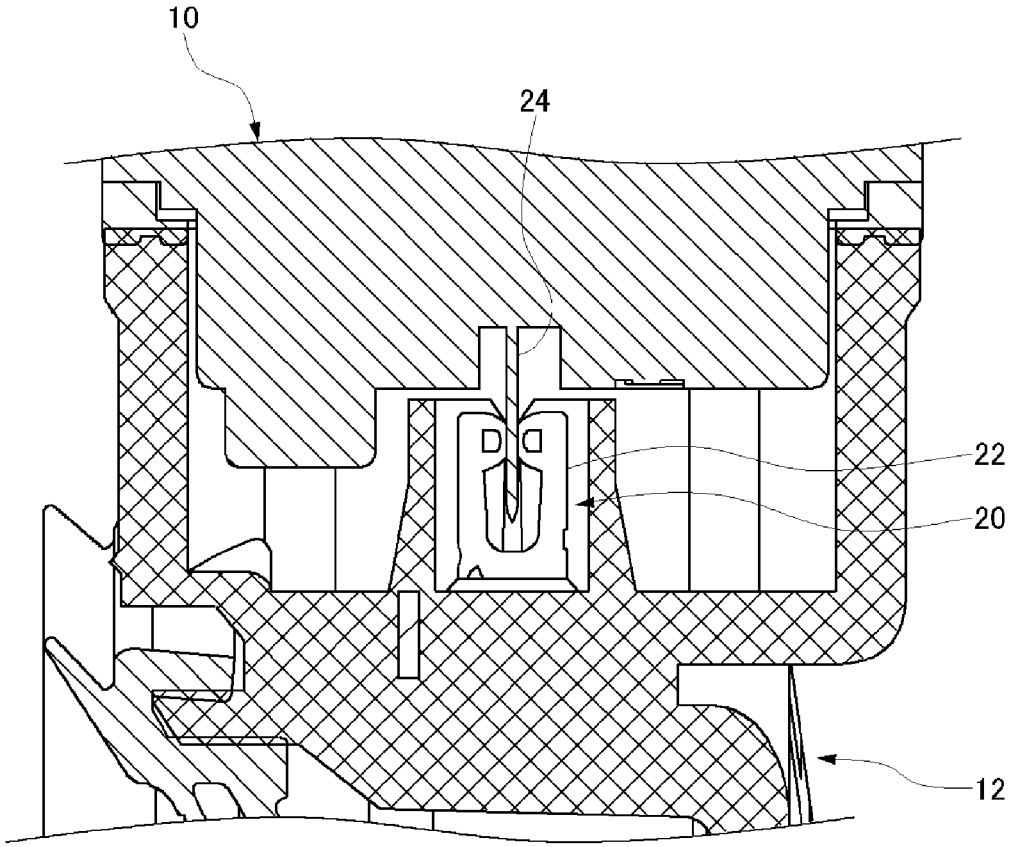
FIG. 3 is a magnified view of the region B shown in FIG. 2.
Figure 4:
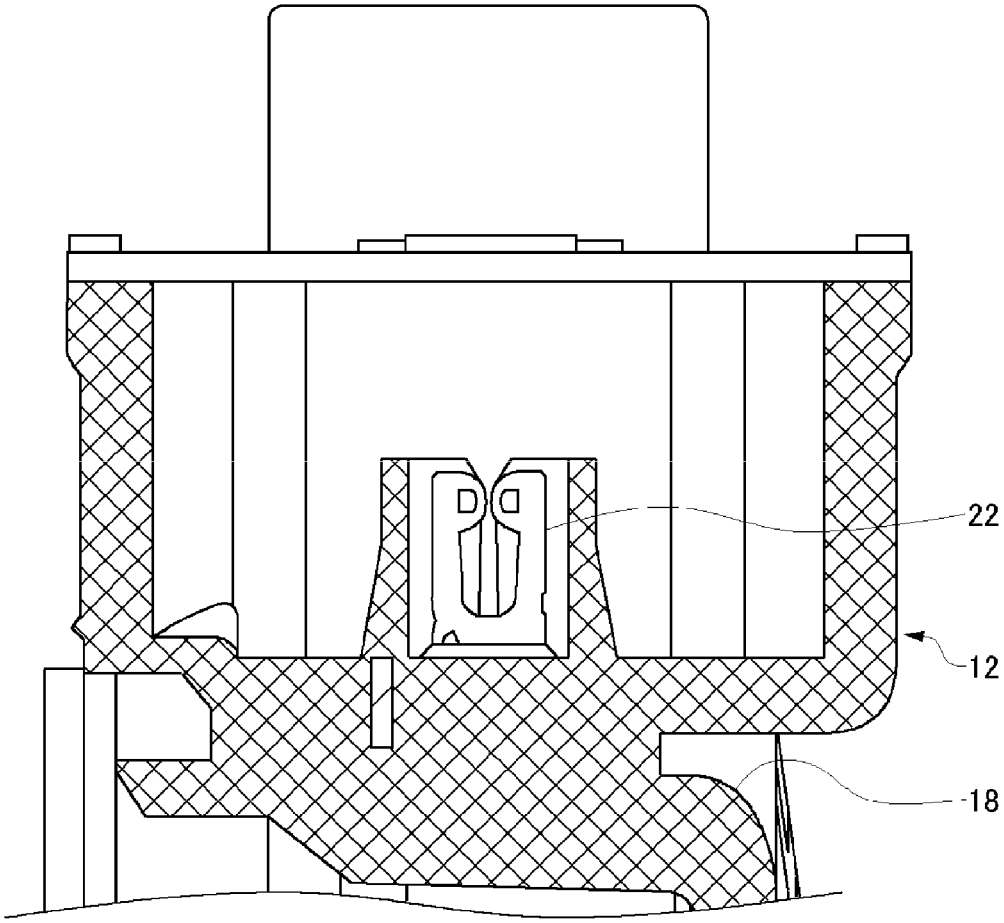
FIG. 4 is a diagram that shows the vicinity of a terminal on the reduction gear side in a power feeding portion.
Figure 5:
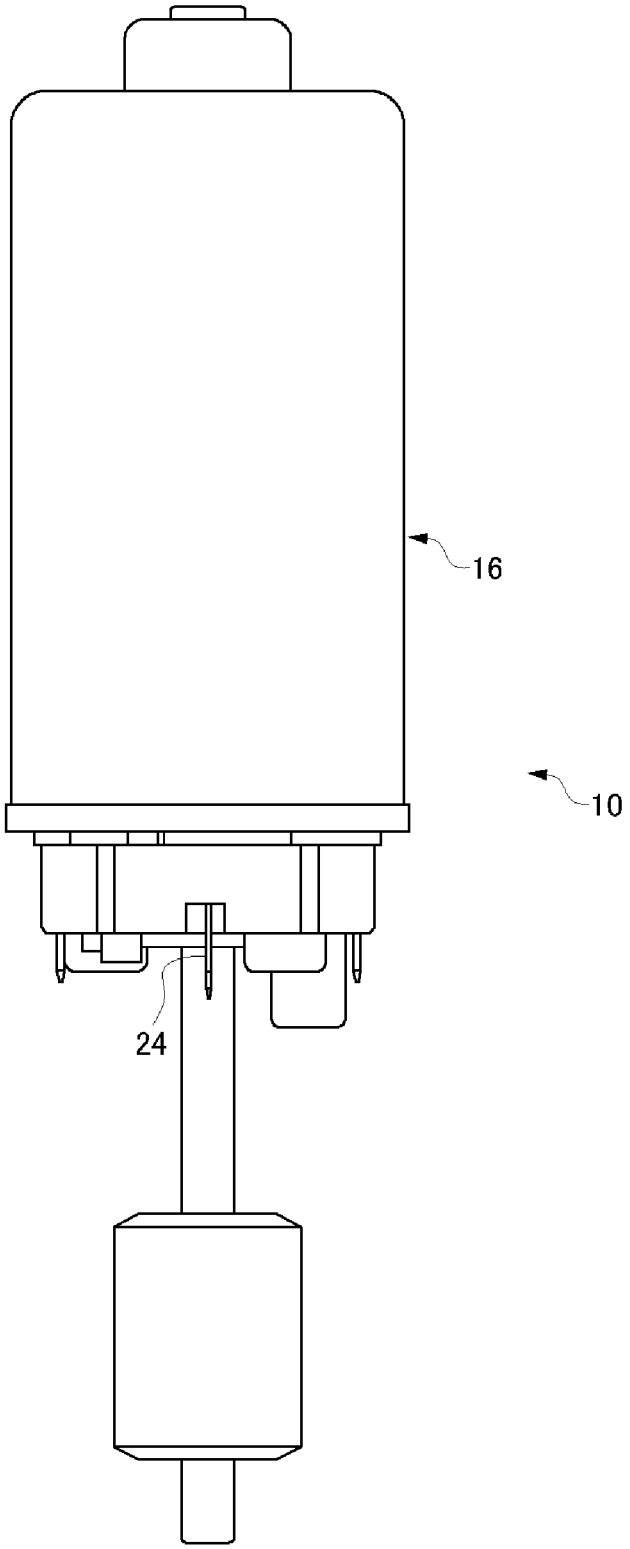
FIG. 5 is a diagram that shows a terminal on the motor unit side in the power feeding portion.

FIG. 2 is a sectional view of the reduction gear-equipped DC motor 100 taken along line A-A of FIG. 1. FIG. 3 is a magnified view of the region B shown in FIG. 2. FIG. 4 shows the vicinity of a terminal on the reduction gear 12 side in a power feeding portion. FIG. 5 shows a terminal on the motor unit 10 side in the power feeding portion.

As shown in FIGS. 2 and 3, a power feeding portion 20 is provided between the motor unit 10 and the reduction gear 12. The power feeding portion 20 is provided along the path which supplies power from the connector 14 to the motor unit 10 via a conductive path (not shown).

The power feeding portion 20 includes a first terminal 22 provided in a space formed on the reduction gear 12 side in the casing 18 as shown in FIG. 4 and a second terminal 24 exposed at the end part in the axial direction of the motor unit 10 as shown in FIG. 5. Although only one first terminal 22 is shown in FIG. 4, as many first terminals 22 as the second terminals 24 are provided on the reduction gear 12 side in the present embodiment.

The first terminal 22 is configured to pinch the thin plate-shaped second terminal 24 with pinching parts provided at the tips of two arms, which will be detailed later. When the motor unit 10 and the reduction gear 12 are fitted together, the second terminal 24 is pinched and held at the tips of the first terminal 22, so that the first terminal 22 and second terminal 24 are electrically connected to each other and form the power feeding portion 20. Conversely, the first terminal 22 may be provided on the motor unit 10 side, and the second terminal 24 may be provided on the reduction gear 12 side.

Figure 6A:
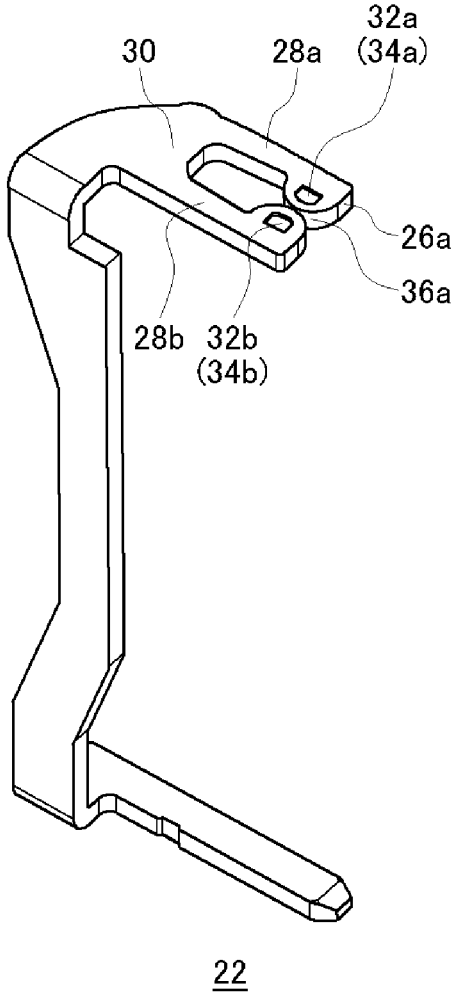
FIG. 6A is a perspective view that shows the entirety of a first terminal according to the present embodiment.
Figure 6B:
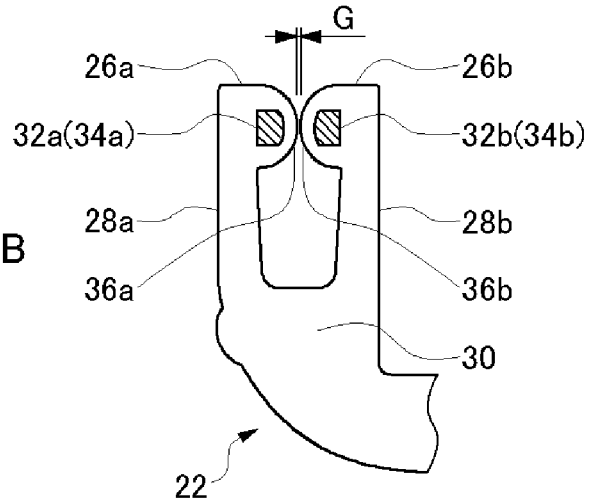
FIG. 6B is a partially magnified view that shows the vicinity of the arms of the terminal shown in FIG. 6A.

The first terminal 22 will now be detailed. FIG. 6A is a perspective view that shows the entirety of the first terminal 22 according to the present embodiment, and FIG. 6B is a partially magnified view of the vicinity of the arms of the first terminal 22 shown in FIG. 6A.

The first terminal 22 is manufactured by stamping a plate member and plastically deforming a part thereof. The plate member may be of highly conductive metal or alloy, and copper or brass (alloy of copper and zinc) is suitable for the material, for example.

The first terminal 22 has electrical connection with the second terminal 24 by pinching and holding the second terminal 24. The first terminal 22 includes a pair of pinching parts 26*a* and 26*b*, a pair of arms 28*a* and 28*b* that are provided with the pinching parts 26*a* and 26*b*, respectively, and a linking section 30 that links the pair of arms 28*a* and 28*b*. The pinching parts 26*a* and 26*b* further include gap adjustment parts 32*a* and 32*b* for adjusting the gap G between the pair of pinching parts 26*a* and 26*b*.

In the first terminal 22, the gap G between the pair of pinching parts 26*a* and 26*b* can be adjusted to be closer to a desired value by means of the gap adjustment parts 32*a* and 32*b* provided in the pinching parts 26*a* and 26*b*.

The gap adjustment parts 32*a* and 32*b* are thinner parts 34*a* and 34*b* that are formed to be thinner than the other parts by partially crushing the pinching parts 26*a* and 26*b*. Accordingly, the fillet of the crushed portion merges into the surrounding part to enlarge the pinching parts 26*a* and 26*b*, so that the gap G between the pinching parts 26*a* and 26*b* becomes smaller. Thus, the gap adjustment parts 32*a* and 32*b* have a function to adjust the gap G. For instance, the size of the gap G can be adjusted by appropriately selecting the size of the thinner parts 34*a* and 34*b*, the positions where the thinner parts 34*a* and 34*b* are formed, or the thickness of the crushed portion.

The positions where the gap adjustment parts are formed in the first terminal are not limited to those shown in FIG. 6, and the gap adjustment part may be formed on the both sides of or on only one side of the pair of pinching parts or may be formed on only one of the pinching parts. Also, the gap adjustment part may be formed on each of the front side of one pinching part and the back side of the other pinching part.

The pinching parts 26*a* and 26*b* further include abutting parts 36*a* and 36*b* that abut onto the second terminal 24 when the pinching parts 26*a* and 26*b* pinch and hold the second terminal 24. The thinner parts 34*a* and 34*b* described above are formed to not include the abutting parts 36*a* and 36*b*. Namely, the abutting parts 36*a* and 36*b* are thicker than the thinner parts 34*a* and 34*b*. Since the thinner parts 34*a* and 34*b* are formed to not reach (or do not extend to) the abutting parts 36*a* and 36*b*, the thinner parts 34*a* and 34*b* do not abut onto the second terminal 24 when the pinching parts 26*a* and 26*b* pinch the second terminal 24, so that the contact area between the abutting part 36*a* or 36*b* and the second terminal 24 is not decreased thereby. Consequently, connection reliability between the first terminal 22 and the second terminal 24 will not be degraded.

As described previously, at least the pair of pinching parts 26*a* and 26*b*, the pair of arms 28*a* and 28*b*, and the linking section 30 of the first terminal 22 are formed of an integrated member of a flat plate shape. Therefore, the first terminal 22 can be manufactured inexpensively using simple processes.

Figure 7A:
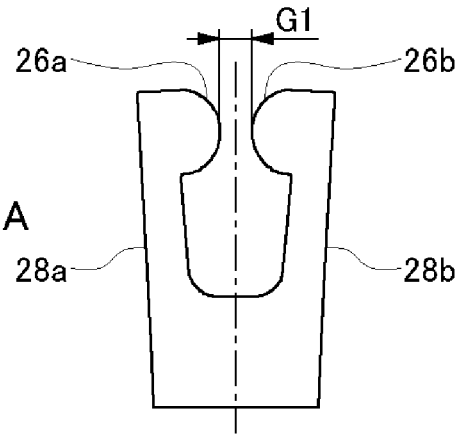
FIG. 7A is a diagram used to describe a first process of a method for manufacturing a terminal.
Figure 7B:
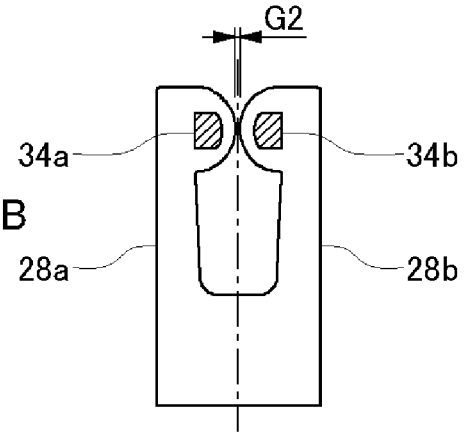
FIG. 7B is a diagram used to describe a second process of the method for manufacturing a terminal.

Next, a method for manufacturing the first terminal 22 will be described. FIG. 7A is a diagram used to describe a first process of a method for manufacturing a terminal, and FIG. 7B is a diagram used to describe a second process of the method for manufacturing a terminal. Although FIGS. 7A and 7B show the processes for the case of manufacturing a single terminal, the application of the method for manufacturing a terminal according to the present embodiment is not limited to the case. For example, the method for manufacturing a terminal according to the present embodiment can be appropriately modified and applied to the case where multiple terminals are simultaneously or sequentially manufactured from one plate member. In the following, the case of manufacturing a single terminal will be described.

First, a plate member is prepared, and a first process of forming a first gap G1 between the two pinching parts 26*a* and 26*b* is performed, as shown in FIG. 7A. In the first process according to the present embodiment, the first gap G1 is formed by stamping a part of the plate member. Accordingly, the first gap G1 can be easily provided in the first process.

Subsequently, a second process is performed in which, by plastically deforming a part of the arms 28*a* and 28*b*, the gap between the pinching parts 26*a* and 26*b* is made to be a second gap G2 smaller than the first gap G1 (see FIG. 7B).

According to such a manufacturing method, the gap between the pinching parts 26*a* and 26*b* can be formed to be the second gap G2 having a small size that cannot be obtained by a single process. Therefore, even if the second terminal 24 is rather thin, the first terminal 22 can certainly pinch and hold the second terminal 24. As a result, connection reliability between the first terminal 22 and the second terminal 24 can be improved.

In the present embodiment, the thinner parts 34*a* and 34*b*, which are thinner than the other parts, are formed in the second process by partially crushing the pinching parts 26*a* and 26*b*. Accordingly, the fillet of the crushed portion merges into the surrounding part to enlarge the pinching parts 26*a* and 26*b*, so that the gap between the pinching parts 26*a* and 26*b* can be made smaller.

Generally, when a part having a gap is to be manufactured by stamping a metal plate with a press, it is difficult to form the gap to be smaller than the thickness of the metal plate. Using the method for manufacturing a terminal according to the present embodiment, however, from a plate member having a thickness t, a terminal having a gap of t/3 or smaller between the pinching parts can be manufactured. Further, by optimizing the manufacturing conditions, a terminal having a gap of about t/4 between the pinching parts can also be manufactured.

In the second process described above, the smaller second gap G2 is formed by partially pressing and crushing the pinching parts 26*a* and 26*b* provided in the arms 28*a* and 28*b*. However, the method for plastically deforming a part of the arms 28*a* and 28*b* in the second process is not limited thereto.

Figure 8:
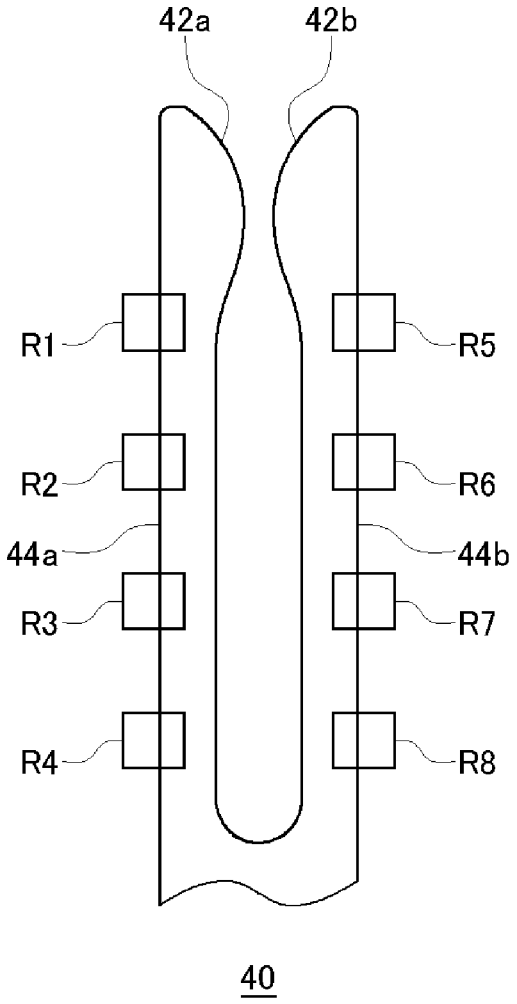
FIG. 8 is a diagram used to describe a modification of the second process of the method for manufacturing a terminal.

FIG. 8 is a diagram used to describe a modification of the second process of the method for manufacturing a terminal. In a terminal 40 shown in FIG. 8, partial regions (R1-R8) of arms 44*a* and 44*b* are pressed in appropriate directions so that pinching parts 42*a* and 42*b* are brought closer to each other and, as a result, the terminal is plastically deformed in the second process. Also with such a method, the gap between the pinching parts 42*a* and 42*b* can be made smaller. As for the regions to be pressed, one or more regions may be appropriately selected in consideration of the intended size of the terminal, the material of the plate, or the shape of the arms.

FIGS. 9A-9D are diagrams used to describe another modification of the second process of the method for manufacturing a terminal.

Figure 9D:
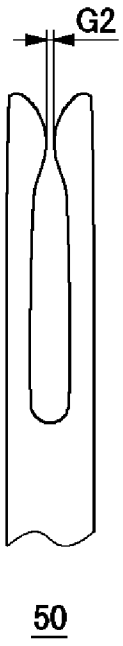
FIGS. 9A-9D are diagrams used to describe another modification of the second process of the method for manufacturing a terminal.
Figure 9C:
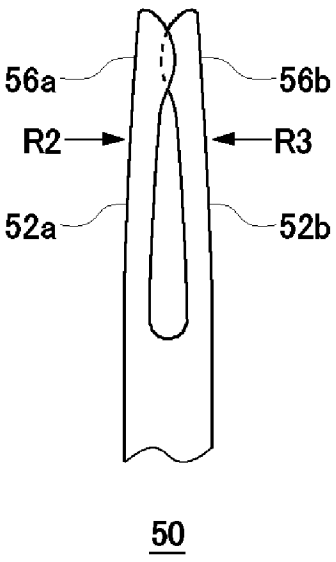
Figure 9B:
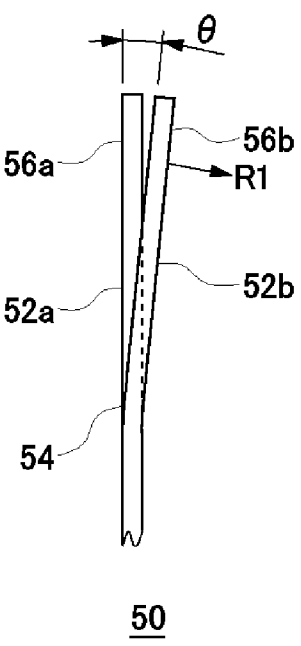
Figure 9A:
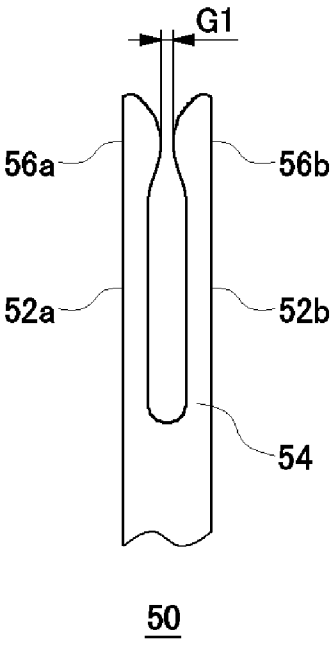

First, a plate member is prepared, and a first process of forming a terminal 50 having a first gap G1 between two pinching parts 56*a* and 56*b* is performed, as shown in FIG. 9A. In the first process according to the present embodiment, the first gap G1 is formed by stamping a part of the plate member. Accordingly, the first gap G1 can be easily provided in the first process.

Next, as shown in FIG. 9B, an arm 52*b* of a pair of arms 52*a* and 52*b* is bent from a bend starting point 54 at the base thereof in the direction of an arrow R1, so that a part of the arm 52*b* is plastically deformed. The bend angle θ in the direction of the arrow R1 is appropriately determined so that a pinching part 56*a* at the tip of the arm 52*a* and a pinching part 56*b* at the tip of the arm 52*b* do not overlap when the terminal 50 is viewed from a side as shown in FIG. 9B.

Subsequently, as shown in FIG. 9C, forces are applied to the arm 52*a* in the R2 direction and to the arm 52*b* in the R3 direction so that the pinching parts 56*a* and 56*b* overlap each other, thereby deforming the arms. The deformation amount may be appropriately determined in consideration of the influence of springback. Thus, since the pinching parts 56*a* and 56*b* are not arranged on the same plane, the deformation amount of the arms 52*a* and 52*b* can be increased at the stage shown in FIG. 9C.

Consequently, even when the tool is released after the bending process shown in FIG. 9C is completed and springback then occurs, the gap between the pinching parts 56*a* and 56*b* is made to be a second gap G2 smaller than the first gap G1 (see FIG. 9D).

The present invention has been described with reference to the aforementioned embodiment. However, the present invention is not limited thereto and also includes a form resulting from appropriate combination or replacement of the configurations in the embodiment. It is also to be understood that appropriate changes of the combination or the order of processes in the embodiment or various modifications, including design modifications, may be made based on the knowledge of those skilled in the art and that such changes and modifications also fall within the scope of the present invention.

What is claimed is:

1. A terminal having electrical connection with a component by pinching and holding the component, the terminal comprising:

a pair of pinching parts;

a pair of arms provided with the pinching parts respectively; and a linking section linking the pair of arms, wherein the pinching parts include a gap adjustment part configured to adjust the gap between the pair of pinching parts, wherein the gap adjustment part is a thinner part formed to be thinner than the other parts by partially crushing the pinching parts, wherein each of the pinching parts further includes an abutting part that abuts onto a component when the pinching parts pinch and hold the component, and wherein the thinner part is formed to not include the abutting part, wherein the pair of pinching parts, the pair of arms, and the linking section are formed of an integrated member of a flat plate shape with opposed flat outer surfaces that fully surround the gap adjustment part.

* * * * *